US008065823B2

(12) United States Patent
Morrell

(10) Patent No.: US 8,065,823 B2
(45) Date of Patent: Nov. 29, 2011

(54) SNOW BLOWER

(75) Inventor: Thomas D. Morrell, Port Washington, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 12/641,369

(22) Filed: Dec. 18, 2009

(65) Prior Publication Data

US 2011/0146112 A1 Jun. 23, 2011

(51) Int. Cl.
*E01H 5/09* (2006.01)

(52) U.S. Cl. ..... 37/254; 37/248; 37/249; 37/252; 37/257; 37/232

(58) Field of Classification Search ..... 37/244, 37/248–259, 232
See application file for complete search history.

(56) References Cited

U.S. PATENT DOCUMENTS

| | | | | | |
|---|---|---|---|---|---|
| 3,182,831 | A * | 5/1965 | Bergmann | 414/705 |
| 3,375,878 | A * | 4/1968 | Dorn | 172/33 |
| 3,941,262 | A * | 3/1976 | Moser et al. | 414/722 |
| 4,266,395 | A * | 5/1981 | Basham | 56/209 |
| 4,281,721 | A * | 8/1981 | Beales | 172/821 |
| 4,317,326 | A * | 3/1982 | Riedinger | 56/14.6 |
| 4,565,018 | A * | 1/1986 | Oya | 37/232 |
| 4,718,537 | A * | 1/1988 | Miller | 198/513 |
| 4,819,348 | A * | 4/1989 | DeBolt | 37/350 |
| 5,114,299 | A * | 5/1992 | Roche et al. | 414/722 |
| 5,410,825 | A * | 5/1995 | Perrelli | 37/254 |
| 5,487,428 | A * | 1/1996 | Yamamoto et al. | 172/4.5 |
| 5,562,398 | A * | 10/1996 | Knutson | 414/732 |
| 5,732,781 | A * | 3/1998 | Chambers | 172/825 |
| 5,782,016 | A * | 7/1998 | Feller et al. | 37/384 |
| 5,938,399 | A * | 8/1999 | Knutson | 414/722 |
| 6,123,156 | A * | 9/2000 | Dufour et al. | 172/795 |
| 6,324,775 | B1 * | 12/2001 | Harnois et al. | 37/266 |
| 6,360,459 | B1 * | 3/2002 | Brookhart et al. | 37/442 |
| 6,751,894 | B2 * | 6/2004 | Verseef | 37/266 |
| 7,351,028 | B2 * | 4/2008 | Potter et al. | 414/723 |
| 7,472,499 | B2 * | 1/2009 | Schmeichel | 37/232 |
| 7,581,339 | B2 * | 9/2009 | Mizoroke et al. | 37/234 |
| 7,617,561 | B2 * | 11/2009 | Couture | 15/306.1 |
| 7,669,353 | B2 * | 3/2010 | Schmeichel | 37/231 |
| 7,681,335 | B2 * | 3/2010 | Schmeichel | 37/232 |
| 2007/0022635 | A1 * | 2/2007 | Yamazaki et al. | 37/244 |

* cited by examiner

*Primary Examiner* — Thomas Beach
*Assistant Examiner* — Matthew Buck
(74) *Attorney, Agent, or Firm* — Rathe Patent & IP Law

(57) ABSTRACT

A snow blower has an auger housing that pivots relative to an axle supporting ground engaging members of the snow blower or about an axis substantially perpendicular to a direction of travel of the snow blower.

23 Claims, 4 Drawing Sheets

SNOW BLOWER

BACKGROUND

Snow blowers are frequently used to assist in the removal of snow from sidewalks, driveways, parking lots and other surfaces. When moving across uneven terrain, traction of the snow blower is sometimes lost and snow is not always cleanly removed.

DETAILED DESCRIPTION OF THE EXAMPLE EMBODIMENTS

Figure 1:
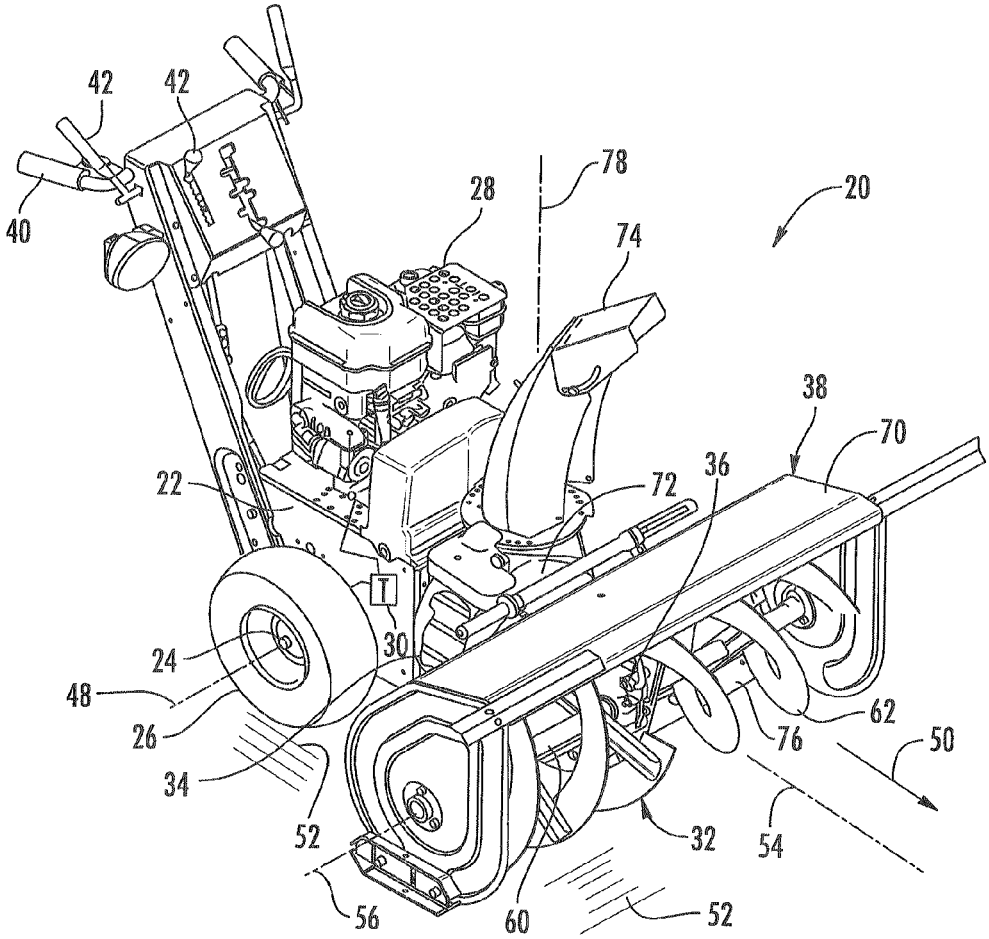
FIG. 1 is a front perspective view of a snow blower according to an example embodiment.

FIG. 1 is a front perspective view of a snow blower 20 according to an example embodiment. As will be described hereafter, snow blower 20 is configured to automatically respond and adjust to changes in the terrain for enhanced traction as well as enhanced snow removal. Snow blower 20 includes frame 22, axle 24, wheels 26, engine 28, drive transmission 30 (schematically shown), auger 32, impeller 34, snow discharge transmission 36 and snow discharge housing 38.

Frame 22 comprises one or more structures supporting the remaining components of snow blower 20. In the example illustrated in which snow blower 20 is a walk-behind snow blower, frame 22 supports axle 24, wheels 26, engine 28, drive transmission 30, auger 32, impeller 34, snow discharge transmission 36 and snow discharge housing 38. Frame 22 further supports handles or grips 40 and controls 42. In other embodiments where snow blower 20 comprises a riding snow blower, frame 22 may additionally support a seat and may be supported by a greater number of wheels, tracks or other ground propulsion members. In embodiments where snow blower 20 is mounted to another vehicle, such as a lawnmower, all terrain vehicle, truck or the like, frame 22 may or may not support axle 24 and wheels 26 and may be configured to be removably mounted to the vehicle. In embodiments where snow blower 20 is powered by the engine or other torque source of the vehicle to which snow blower 20 is mounted, frame 22 may not support an engine, such as engine 28, and may alternatively merely comprise a mounting structure or bracket supporting auger 32, impeller 34 and discharge housing 38 and facilitating their connection to the vehicle. Frame 22 may have a variety of different sizes, shapes and configurations depending upon the machine or method by which snow blower 20 is moved across the terrain.

Figure 2:
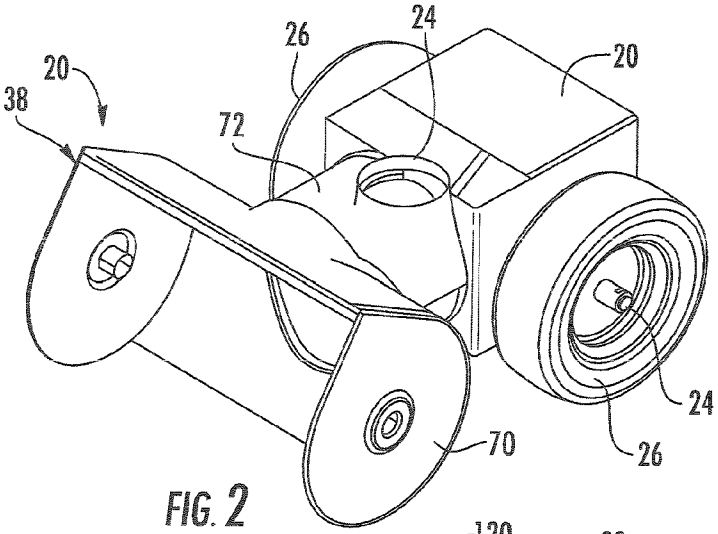
FIG. 2 is a front perspective view of portions of the snow blower of FIG. 1 including a frame, axle supporting ground engaging members and a discharge housing.
Figure 3:
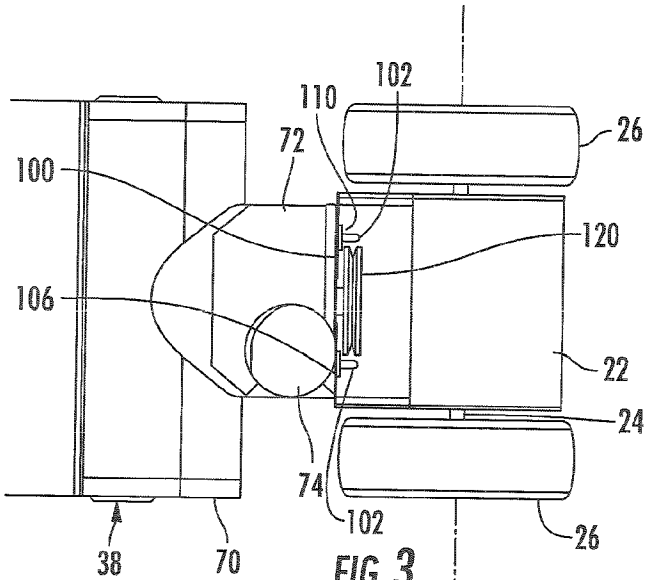
FIG. 3 is a top plan view of those portions of the snow blower shown in FIG. 2.

Axle 24 is supported by frame 22 and rotationally supports wheels 26 (both of which are shown in FIG. 2). In the example illustrated, axle 24 is configured to be rotationally driven by engine 28 using torque transmitted by transmission 30. Axle 24 extends along an axis 48 that is substantially perpendicular to the direction of travel 50 of snow blower 20.

Wheels 26 are joined to axle 24 so as to elevate and support frame 22 above the terrain 52. Wheels 26 further facilitate movement of snow blower 20 across terrain 52. In the example illustrated, wheels 26 are rotationally driven to propel snow blower 20. In other embodiments, wheels 26 may be physically pushed by a person or other vehicle. In some embodiments, wheels 26 may be replaced with one of more tracks or other ground engaging members. In embodiments where snow blower 20 is supported along the terrain by another vehicle, axle 24 as well as wheels 26 may be omitted.

Engine 28 comprises an internal combustion engine supported by frame 22 and operably coupled to wheels 26 by drive transmission 30 so as to drive wheels 26. Engine 28 is further operably coupled to auger 32 and impeller 34 by discharge transmission 36 so as to rotationally drive auger 32 about axis 56 and so as to rotationally drive impeller 34 about axis 54. In other embodiments, engine 28 may alternatively only drive auger 32 and impeller 34. In other embodiments, other mechanisms may be used to drive auger 32, impeller 34 or drive wheels 26.

Transmission 30 (schematically shown) comprises a series or arrangement of structures configured to transmit torque from engine 28 to axle 24 or wheels 26. Likewise, auger transmission 36 comprises a series or arrangement of structures configured to transmit torque from engine 28 to auger 32 and impeller 34. Examples of such structures include, but are not limited to, drive shafts and driven shafts, chain and sprocket arrangements, belt and pulley arrangements, gear trains and combinations thereof. In one embodiment, transmission 36 is disposed on both sides of impeller 34, wherein transmission 36 extends between engine 28 and impeller 34 and wherein transmission 36 further extends between impeller 34 and auger 32. For example, in one embodiment, transmission 36 may include a bevel gear between impeller 34 and auger 32 for converting torque about axis 54 from impeller 34 to torque about axis 56 for auger 32.

Auger 32 comprises a mechanism configured to slice or cut through snow and to direct or move such snow towards impeller 34. Auger 32 includes a central shaft 60 supporting a helical ribbon or blade 62. Shaft 60 is rotationally supported about axis 56. Blade 62 cuts through the snow and directs snow towards axis 54 and towards an inlet opening to impeller 34. In other embodiments, auger 32 may have other configurations. For example, in lieu comprising ribbons, blade 62 may comprise full blades continuously extending from shaft 60.

Impeller 34 comprises a series of paddles or blades circumferentially arranged about axis 54 and configured to be rotationally driven about axis 54. Impeller 34 is configured to receive the snow gathered and directed to it by auger 32 and to further impel snow away from snow blower 20.

Snow discharge housing 38 comprises one or more structures configured to guide and direct the movement and the discharge of snow. Snow discharge housing 38 includes auger housing 70, impeller housing 72 and discharge chute 74. Auger housing 70 forms the head of snow blower 20 and partially extends about or partially surrounds auger 32. Auger housing 70 rotationally supports auger 32 for rotation about axis 56 which is perpendicular to axis 54 and the direction of forward travel 50.

Auger housing 70 includes scraper blade 76. Scraper blade 76 comprises a rigid blade extending perpendicular to axis 54 between auger 32 and impeller 34. Scraper blade 76 contacts and scrapes against terrain 52 within auger housing 70 such a scrape and lift snow from terrain 52 and towards impeller 34.

Impeller housing 72 extends about impeller 34 and opens into an interior of auger housing 70. Impeller housing 72 further opens into chute 74. Impeller housing 72 cooperates with impeller 34 such that snow impelled or moved by impeller 34 is directed up and through chute 74.

Chute 74 comprises one or more structures configured to receive snow impelled by impeller 34 and to direct such snow away from snow blower 20. In the example illustrated, chute 74 is configured to be selectively rotated about a substantially vertical axis 78 such that snow may be blown or thrown to either transverse side of snow blower 20 and at various rear and forward angles with respect to snow blower 20. In one embodiment, chute 74 is configured to be manually rotated about axis 78. In other embodiments, such rotation may be powered. In yet other embodiments, chute 74 may be stationary.

As will be described in more detail hereafter, at least auger housing 70 and its scraper blade 76 are movably supported so as to rotate or pivot about axis 54 or about a plurality of axes parallel to axis 54. In other words, auger housing 70 is movably supported so as to rotate or pivot about one of more axes extending in or parallel to the forward direction of travel 50 of snow blower 20. As a result, the orientation of auger housing 70 and auger 32 automatically changes or adjusts to changes in terrain 52. In particular, when portions of terrain 52 contacting scraper blade 76 and auger housing 70 are at different angles with respect to portions of terrain 52 contacting wheels 26 (or other ground engaging propulsion members of snow blower 20), auger housing 70, under the force of gravity or with the assistance of one or more bias members (springs and the like) urging blade 76 against terrain 52, automatically pivots or rotates about axis 54.

The ability of auger housing 70 to automatically change its orientation about axis 54 allows scraper blade 76 to remain substantially parallel to portions of terrain 52 opposite to scraper blade 76. In addition, the ability of auger housing 72 automatically change its orientation about axis 54 allows axle 24 to remain parallel to portions of terrain 52 underlying axle 24 and allows wheels 26 or any other ground engaging members employed by snow blower 20 to remain in solid contact and traction with portions of the terrain 52.

Figure 5:
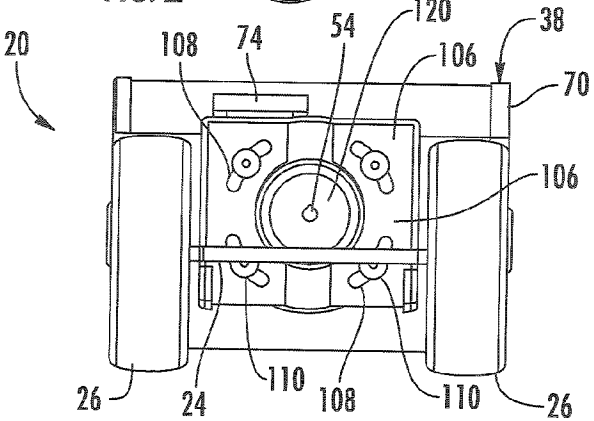
FIG. 5 is a rear elevational view of those portions of the snow blower shown in FIG. 2.
Figure 4:
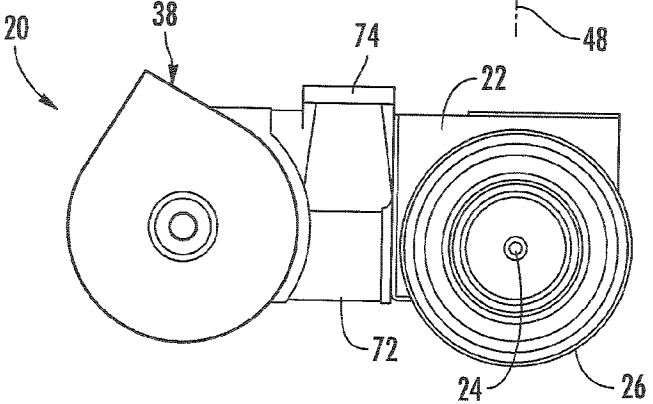
FIG. 4 is a left side elevational view of those portions of the snow blower shown in FIG. 2.
Figure 6:
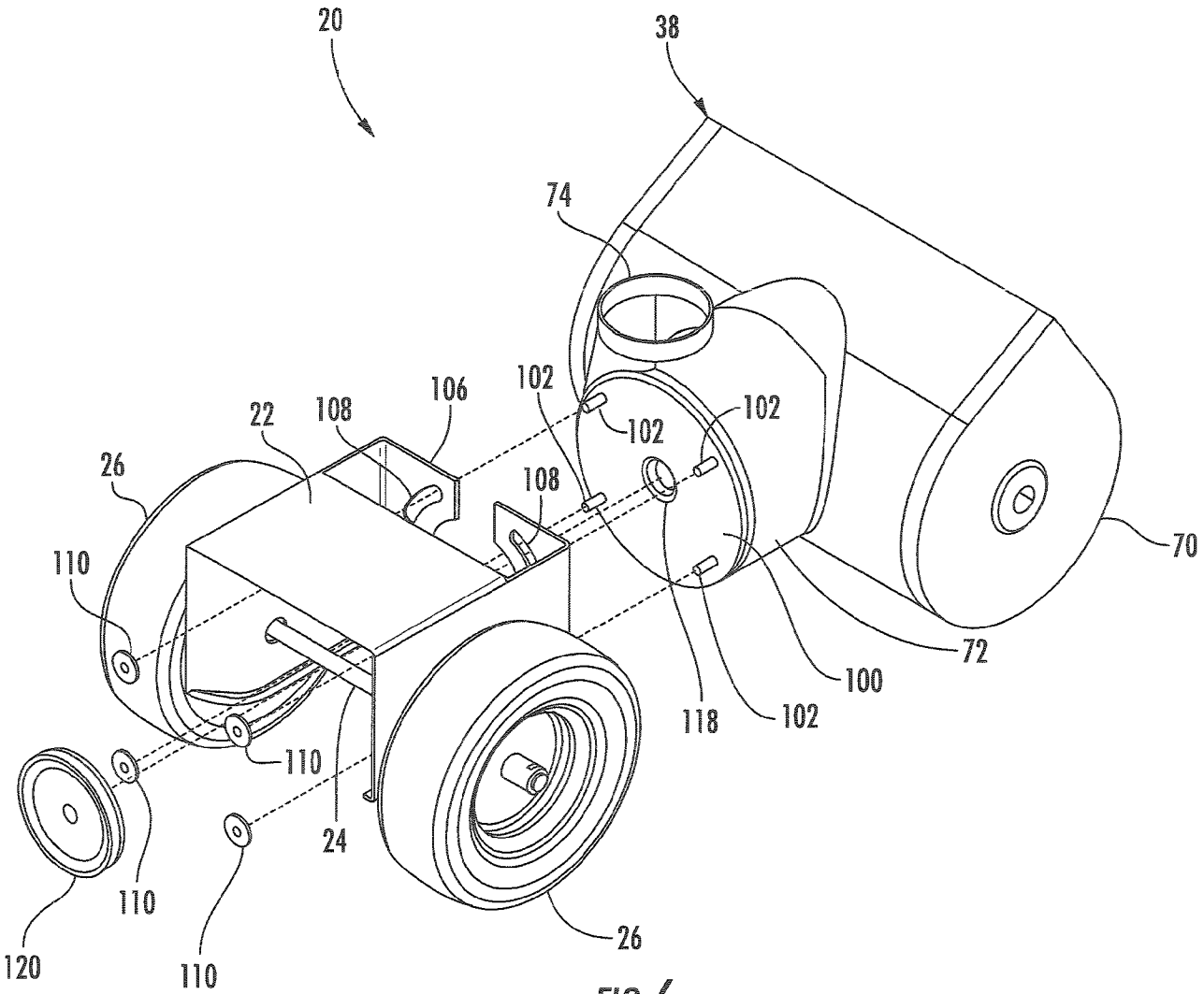
FIG. 6 is an exploded rear perspective view of those portions of the snow blower shown in FIG. 2.

FIGS. 2-6 illustrate portions of snow blower 20 in more detail. FIGS. 2-6 illustrate portions of frame 22, axle 24, wheels 26, discharge transmission 36 and discharge housing 38 in more detail while omitting engine 28, auger 32 and impeller 34 for purposes of illustration. As shown by FIG. 6, in the example illustrated, auger housing 70 and impeller housing 72 are joined and fixed to one another so as to move as a single unit. Auger housing 70 and impeller housing 72 pivot or rotate about axis 54 in unison with one another and relative to frame 22. In other embodiments, impeller housing 72 may be fixed to frame 22, wherein auger housing 70 pivots or rotates about axis 54 relative to impeller housing 72.

In the example illustrated, rotation of discharge housing 38, including auger housing 70, is guided using one or more arcuate slots centered about axis 54 and one or more corresponding pins, bolts, screws or other protuberances slidably received within such arcuate slots. As shown by FIGS. 5 and 6, in the example illustrated, discharge housing 38 includes a plate 100 from which four projections or protuberances 102 extend. The frame 22 includes a plate 106 having four arcuate slots or channels 108 into which and through protuberances 102 project. In the example illustrated, protuberances 102 comprise bolts or screws welded to plate 100. In other embodiments, protuberances 102 may be secured to plate 100 in other fashions or may be integral with plate 100.

In the example illustrated, each slot 108 has a sufficient arcuate length to allow plate 100 and discharge housing 38 to rotate or pivot through an arc of at least 2 degrees about axis 54. In the example illustrated, each slot 108 has a sufficient arcuate length to allow discharge housing 38 to rotate through an arc of at least about 10 degrees and nominally about 17 degrees about axis 54. Although the pivoting or rotation of auger housing 70 is illustrated as being guided by protuberances 102 extending from discharge housing 38 and slots 108 provided in plate 106 of frame 22, in other embodiments, this relationship may be reversed. In particular, protuberances 102 may alternatively extend from frame 22 while slots 108 are provided in plate 100. In other embodiments, each of plates 100 and 106 may include both cooperating slots 108 and protuberances 102. Instead of having four grooves and four protuberances, snow blower 20 may alternatively utilize a greater or fewer of such slots and protuberances. In one embodiment, plate 100 or plate 106 may include a single continuous annular slot or channel which receives one or more protuberances 102. In still other embodiments, discharge housing 38 may be rotatably supported relative to frame 22 using a shaft or other bearing structures extending along and centered about axis 54. In still other embodiments, other mechanisms may be used to rotationally support auger housing 70 for rotation with respect to axle 24 and wheels 26.

As shown by FIGS. 5 and 6, the surfaces of plates 100 and 106 are spaced apart by pivot spacers 110 which are positioned on protuberances 102. In the example illustrated, pivot spacers 110 comprise top hat shaped washers having a narrow diameter portion received within the slot 108 and a wider diameter portion sandwiched between frame 22 and housing 38. Pivot spacers 110 serve as bearings by reducing frictional contact between plates 100 and 106 to facilitate their relative movement. In other embodiments, additional bearing structures may be provided between frame 22 and discharge housing 38. For example, ball bearings, roller bearings, low friction surfaces (polytetraflouroethylene (TEFLON) surfaces, nylon surfaces and the like) or lubricated surfaces may additionally be provided to facilitate relative rotation between frame 22 and discharge housing 38. In embodiments where auger housing 70 rotates relative to impeller housing 72, such bearing mechanisms may alternatively be provided between auger housing 70 and impeller housing 72.

As shown by FIG. 6, plate 100 additionally includes an aperture 118 through which to torque is transmitted by discharge transmission 36 to each of auger 32 and impeller 34. In the example illustrated, discharge transmission 36 includes a drive pulley 120 connected to a belt (not shown) which is driven by torque supplied by engine 28. Drive pulley 120 is operably coupled to the shaft of impeller 34. The shaft of impeller 34 extends through opening 118 and is centered about axis 54. As a result, engine 28 may continue to deliver torque to auger 32 and impeller 34 while or as auger housing 70 is pivoting a rotating about axis 54 relative to frame 22.

Figures 7, 8, 9:
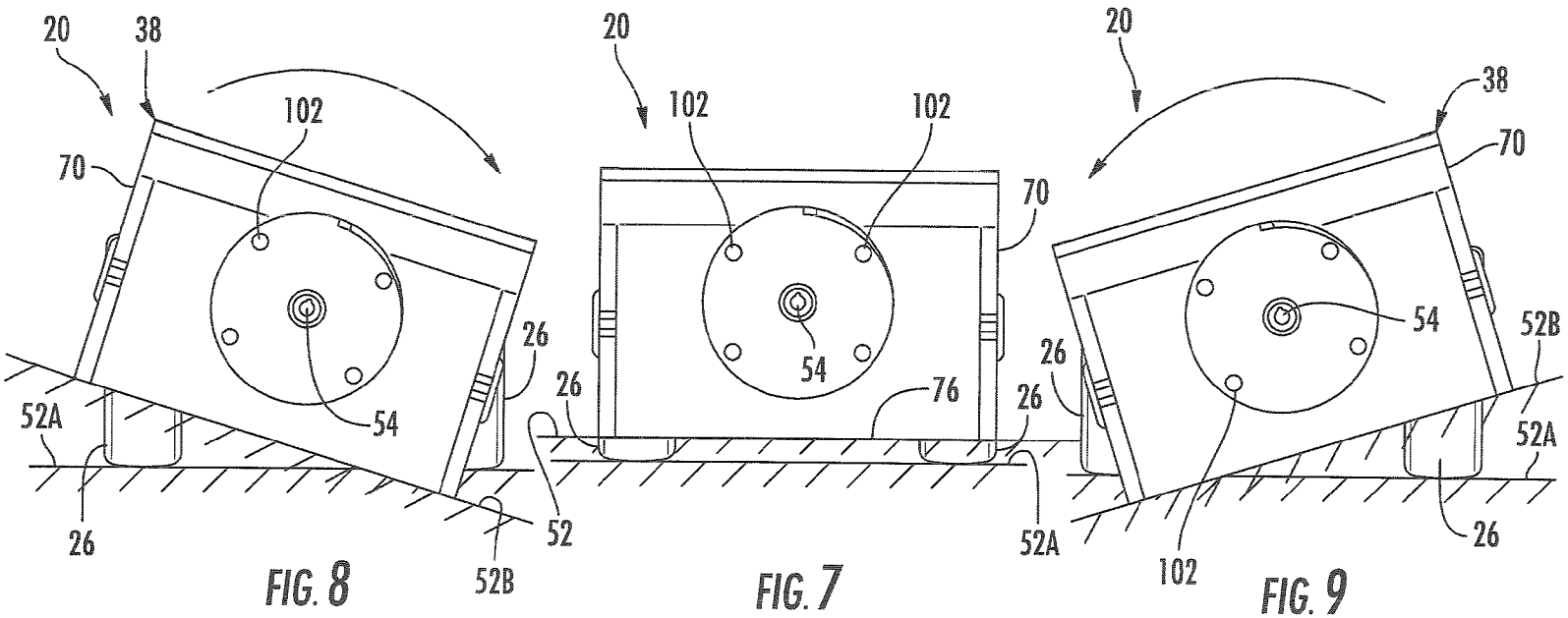
FIG. 7 is a front elevational view of those portions of the snow blower shown in FIG. 2 when the ground engaging members and the auger housing are contacting even or parallel terrains.
FIGS. 8 and 9 are front elevational views of those portions of the snow blower shown in FIG. 2 when the ground engaging members and the auger housing are contacting uneven terrains.

FIGS. 7-9 are front end views of those portions of snow blower 20 shown in FIGS. 2-5. FIG. 7 illustrate discharge housing 38 and its auger housing 70 when the terrain 52 beneath tires 26 (labeled as terrain 52A) is parallel to or level with the terrain 52 (labeled as terrain 52B) in contact with scraper blade 76 of auger housing 70. FIGS. 8 and 9 illustrate discharge housing 38 and its auger housing 70 when the terrain 52 beneath tires 26 (labeled as terrain 52A) is angled with respect to or level with the terrain 52 (labeled as terrain 52B) in contact with scraper blade 76 of auger housing 70. For purposes of illustration, the angular difference between terrain 52A and 52B is exaggerated. FIG. 8 illustrates auger housing 70 pivoting or rotating about axis 54 in a clockwise direction (as seen in FIG. 8) with respect to wheels 26 and axle 24 (shown in FIG. 1). FIG. 9 illustrates auger housing 70 pivoting or rotating about axis 54 in a counterclockwise direction (as seen in FIG. 9) with respect to wheels 26 and axle 24 (shown in FIG. 1). Said in another way, FIG. 8 illustrates frame 22 and its axle 24 (shown in FIG. 1) rotating about axis 54 in a counterclockwise direction relative to auger housing 70. FIG. 9 illustrates frame 22 and its axle 24 rotating about axis 54 and a clockwise direction relative to auger housing 70. This relative orientation adjustment of auger housing 70 occurs under the force of gravity automatically in response to differences between terrains 52A and 52B. As a result, even when uneven trains are encountered, scraper blade 76 remains in substantial contact with terrain 52B while wheels 26 remain in substantially continuous contact with terrain 52B. Consequently, both traction and snow removal performance of snow blower 20 are enhanced.

Although the automatic angular adjustment of auger housing 70 with respect to frame 22, axle 24 and wheels 26 has been illustrated and described with respect to a walk-behind self-propelled snow blower 20, the disclosed features may alternatively be used in other snow blowers. For example, such features may be utilized with self-propelled snow blowers in which a person rides the snow blower, with manually propelled or human propelled/pushed snow blowers and with snow blowers which are mounted to vehicles such as lawnmowers, all terrain vehicles, trucks or other vehicles. In such embodiments, auger housing 70 rotates or pivots about an axis perpendicular to an axle of the vehicle or about an axis parallel to or coincident with a forward direction of travel of the vehicle.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A snow blower comprising:

a frame;

ground engaging members configured to support the frame above a first terrain having a first inclination;

an auger; and an auger housing partially about the auger, the auger housing having a discharge chute and a mouth, the mouth facing in a direction, wherein the housing is movably supported by the frame for automatic movement relative to the frame about one or more first axes extending in the direction such that while the ground engaging members support the frame above the first terrain having the first inclination, the auger housing extends parallel to a second terrain having a second inclination different than the first inclination, wherein the auger housing is configured to automatically move relative to the frame without any operator input and in response to inclination differences between the first terrain and the second terrain.

2. The snow blower of claim 1 further comprising wheels coupled to the frame and rotatable about a second axis perpendicular to the one or more first axes, wherein the housing is movable to extend along a third axis perpendicular to the direction, angularly offset from the second axis about the direction and parallel to the second terrain having the second inclination.

3. The snow blower of claim 1 further comprising:

an engine; and a transmission between the engine and the wheels to drive the wheels.

4. The snow blower of claim 1, wherein one of the frame and the housing includes an arcuate slot and wherein the other of the frame and the housing has a protuberance extending therefrom through the arcuate slot.

5. The snow blower of claim 4, wherein the frame includes the arcuate slot.

6. The snow blower of claim 1 further comprising a scraper bar along a lower edge of the housing and perpendicular to the direction, wherein the auger housing is automatically movable in response to terrain changes such that the scraper blade remains parallel to terrain underlying the scraper blade.

7. The snow blower of claim 1 further comprising:

an impeller housing fixed to the auger housing, wherein the impeller housing includes a first plate perpendicular to the direction and wherein the frame includes a second plate perpendicular to the direction; and a bearing between the first plate in the second plate to facilitate relative movement of the first plate and the second plate.

8. The snow blower of claim 7 further comprising:

an aperture through the first plate;

an engine supported by the frame; and a transmission having a portion extending from the engine through the aperture to the auger.

9. The snow blower of claim 1, wherein the movement of the auger housing relative to the frame is a rotational movement.

10. The snow blower of claim 9, wherein the auger housing rotates at least 2 degrees about the one or more first axes.

11. The snow blower of claim 1, wherein the auger housing is configured to automatically move relative to the frame solely under the force of gravity.

12. The snow blower claim 1, wherein the auger housing is configured to automatically move relative to the frame so as to maintain a majority of a bottom edge of the auger housing against the second terrain having the second inclination while the ground engaging members support the frame above the first terrain having the first inclination.

13. A method comprising:

driving an auger of a snow blower;

pivoting a mouth of an auger housing of the snow blower relative to an axle of the snow blower such that the mouth extends parallel to terrain underlying the auger housing while the auger is being driven and while the axle extends non-parallel to the terrain underlying the auger housing; and moving the snow blower straight ahead immediately following the pivoting of the mouth of the auger housing, wherein the mouth of the auger housing is automatically pivoted without operator input under and the force of gravity.

14. The method of claim 13, wherein the axle rotationally supports wheels.

15. The method of claim 13 further comprising moving the snow blower across a terrain in a first direction, wherein the pivoting of the mouth is about one or more axes along the first direction.

16. The method of claim 13 further comprising guiding pivoting movement of the auger housing with an arcuate slot.

17. The method of claim 13, wherein a frame supports an engine of the snow blower and wherein the auger housing is pivoted relative to the frame.

18. A snow blower comprising:

a frame;

an engine supported by the frame;

an axle supported by the frame;

wheels supported by the axle;

an auger;

a transmission extending between the engine and the auger to drive the auger; and an auger housing partially about the auger, the auger housing having a discharge chute and a mouth, wherein the auger housing is configured to pivot relative to the axle about an axis perpendicular to the axle in response to changes in terrain contacting the auger housing as the snow blower is moved across the terrain, wherein the auger housing is configured to automatically pivot relative to the frame without operator input and under the force of gravity.

19. The snow blower of claim 18, wherein one of the frame and the auger housing includes an arcuate slot and wherein the other of the frame and the auger housing has a protuberance extending therefrom through the arcuate slot.

20. The snow blower of claim 19, wherein the frame includes the arcuate slot.

21. The snow blower of claim 18, wherein the housing includes a first plate parallel to the axle and wherein the frame includes a second plate parallel to the axle and in sliding contact with the first plate.

22. The snow blower of claim 21 further comprising:

an aperture through the first plate;

an engine supported by the frame, wherein torque is transmitted from the engine through the aperture to the auger.

23. The snow blower of claim 18, wherein the auger housing is rotatable by at least 2 degrees.

* * * * *